US008210657B2

(12) United States Patent
Akahane

(10) Patent No.: US 8,210,657 B2
(45) Date of Patent: Jul. 3, 2012

(54) LIQUID JET HEAD AND A LIQUID JET APPARATUS

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 466 days.

(21) Appl. No.: 12/397,243

(22) Filed: Mar. 3, 2009

(65) Prior Publication Data

US 2009/0231391 A1 Sep. 17, 2009

(30) Foreign Application Priority Data

Mar. 4, 2008 (JP) ..... 2008-053131

(51) Int. Cl.
*B41J 2/045* (2006.01)

(52) U.S. Cl. ..... 347/68

(58) Field of Classification Search ..... 347/67–72
See application file for complete search history.

(56) References Cited

U.S. PATENT DOCUMENTS 6,994,428 B2 2/2006 Ito
7,607,760 B2 10/2009 Ito
7,866,800 B2 * 1/2011 Kubo et al. ..... 347/68
7,954,916 B2 6/2011 Sugahara

FOREIGN PATENT DOCUMENTS

JP 09-057966 A 3/1997
JP 2003-080700 A 3/2003
JP 2003-334946 A 11/2003
JP 2005-254579 A 9/2005
JP 2007-083426 A 4/2007

* cited by examiner

*Primary Examiner* — Lamson Nguyen
(74) *Attorney, Agent, or Firm* — Kilpatrick Townsend & Stockton LLP

(57) ABSTRACT

A liquid jet head includes: a pressure generation element; a nozzle plate which is provided with a nozzle opening; a pressure generating chamber plate in which a pressure generating chamber for communicating to the nozzle opening is formed; and a nozzle communication plate in which a communication through hole for communicating the one pressure generating chamber with a plurality of nozzle openings is provided between the nozzle plate and the pressure generating chamber plate, so that, for example, a plurality of the nozzle openings can be disposed in a lined-up direction of the pressure generating chambers at a predetermined pitch smaller than a lined-up pitch of the pressure generating chamber.

6 Claims, 7 Drawing Sheets

LIQUID JET HEAD AND A LIQUID JET APPARATUS

CROSS REFERENCES TO RELATED APPLICATIONS

The present invention contains subject matter related to Japanese Patent Application No. 2008-53131 filed in the Japanese Patent Office on Mar. 4, 2008, the entire contents of which are incorporated herein by reference.

BACKGROUND OF THE INVENTION

1. Field of the Invention

The present invention relates to a liquid jet head and a liquid jet apparatus.

2. Description of the Related Art

In a known recording head, it has been difficult to dispose nozzle openings in high density. For this reason, Japanese Patent Application Laid-Open Publication NO. 2003-080700 discloses the configuration in which a plurality of nozzle openings (hereinafter, refer to as a nozzle set) is formed on one pressure generating chamber, for example. According to such a configuration, ink is simultaneously ejected from each nozzle opening corresponding to the pressure generating chamber of a driving target by one ejecting operating, and the ink is landed on a recording medium such as a recording paper to form a plurality of dots simultaneously. With such a configuration, it is possible to increase a formation density of the nozzle without changing a lined-up pitch of the pressure generating chamber.

Also in the configuration for forming a plurality of nozzle openings on one pressure generating chamber, since the nozzle openings are disposed in a region of the pressure generating chamber when it is viewed in a projected plan state, the formation density in the nozzle openings on the same pressure generating chamber can be increased. In contrast, since there is a partition wall between adjacent pressure generating chambers, it is impossible to dispose the nozzle opening in the region (immediately below the partition wall) of the partition wall. Therefore, the lined-up pitch of the nozzle openings in the adjacent pressure generating chambers is easily influenced by the formation pitch of the pressure generating chamber as before.

SUMMARY OF THE INVENTION

The invention is made to solve at least one of the above problems and it can be realized through the following aspects or applications.

According to an aspect to which the invention is applied, there is provided a liquid jet head including; a pressure generation element; a nozzle plate which is provided with a nozzle opening; a pressure generating chamber plate in which a pressure generating chamber for communicating with the nozzle opening is formed; and a nozzle communication plate in which a communication through hole for communicating one pressure generating chamber with a plurality of nozzle openings is provided between the nozzle plate and the pressure generating chamber plate.

The other characteristics and objects of the invention will be apparent through the description of the present specification with reference to the accompanying drawings.

BRIEF DESCRIPTION OF THE DRAWINGS

To completely understand the invention and advantages thereof, the invention will be described with reference to the following description and the accompanying drawings together.

DETAILED DESCRIPTION OF THE PREFERRED EMBODIMENTS

Figure 1:
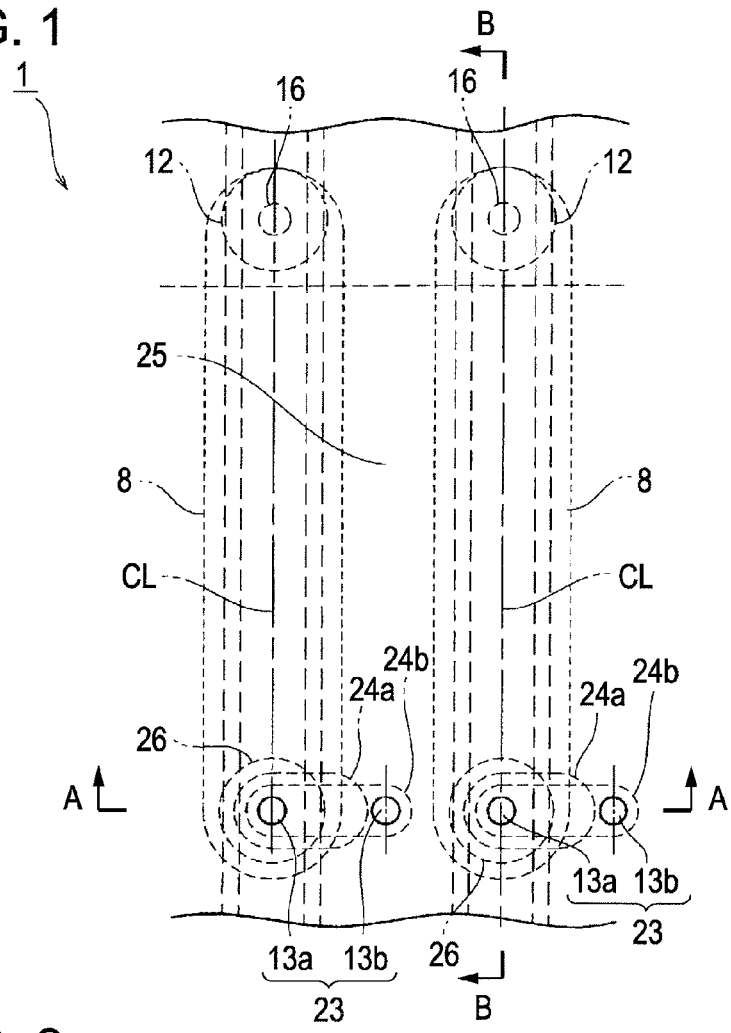
FIG. 1 is an enlarged plan view illustrating a main portion when a liquid jet head is viewed from a nozzle plate.

At least following aspects will be apparent through the description of the present specification and the accompanying drawings.

According to an aspect of a liquid jet head, there is provided a liquid jet head including; a pressure generating element; a nozzle plate provided with a nozzle opening; a pressure generating chamber plate in which the pressure generating chamber communicating with the nozzle opening, and a nozzle communication plate in which a communication hole communicating with a plurality of the nozzle openings on one pressure generating chamber is provided between the nozzle plate and the pressure generating chamber plate.

According to this configuration, flexibility in an arrangement layout of the nozzle opening can be improved without being easily influenced by the formation pitch of the pressure generating chamber. Therefore, for example, it is possible to arrange a plurality of the nozzle openings in a lined-up direction of the pressure generating chambers at a predetermined pitch smaller than the lined-up pitch of the pressure generating chamber.

In addition, according to another aspect of a liquid jet head, there is provided a liquid jet head in which a nozzle communication plate is configured to include a plurality of plates, and in which both communication through holes communicate with each other in a state where the center of a communication through hole of a nozzle communication plate closest to the nozzle plate among the plurality of nozzle communication plates is shifted with respect to the center of a communication through hole of a nozzle communication plate closest to the pressure generating chamber plate.

According to this configuration, the centers of the communication through holes of the respective nozzle communication plates are disposed by being shifted from each other, so that it is possible to deal with various layouts of the nozzle openings.

In addition, according to another aspect of a liquid jet head, there is provided a liquid jet head in which at least a part of a plurality of the nozzle openings communicating with the same pressure generating chamber via the communication through hole faces the pressure generating chamber of the nozzle plate.

In addition, according to another aspect of a liquid jet head, there is provided a liquid jet head further including a nozzle set which is configured such that the nozzle openings communicating with the same pressure generating chamber are disposed in a polygonal shape, in which a plurality of the nozzle sets is disposed in a lined-up direction of the pressure generating chambers in a state where orientations of the polygonal shapes are different in an alternative manner.

In addition, the liquid jet apparatus mounting a liquid jet head mounts the liquid jet head.

As a result, it is possible to provide the liquid jet apparatus in which the flexibility in an arrangement layout of the nozzle opening can be improved, and a high density arrangement of nozzles is possible, so that an ejecting result with high density can be obtained.

Hereinafter, preferred embodiments of the invention will be described with reference to the drawings. Further, the embodiments to be described below are shown as an example of the invention and all the configurations to be described are not limited as an essential constituent component of the invention.

Best Embodiment

In the following, the embodiments will be described on the basis of the drawings.

First Embodiment

Hereinafter, the best mode for carrying out the present invention will be described with reference to the accompanying drawings. In addition, in the embodiments to be described below, the invention is limited as various suitable specific examples. However, the scope of the invention is not limited to these embodiments if there is no specific gist of the limitation in the following description. In addition, in the following description, an ink jet recording head (hereinafter, simply refers to as a recording head) mounted on an ink jet recording apparatus (a kind of the liquid jet apparatus of the invention) will be exemplarily described as the liquid jet head of the invention.

Figure 2:
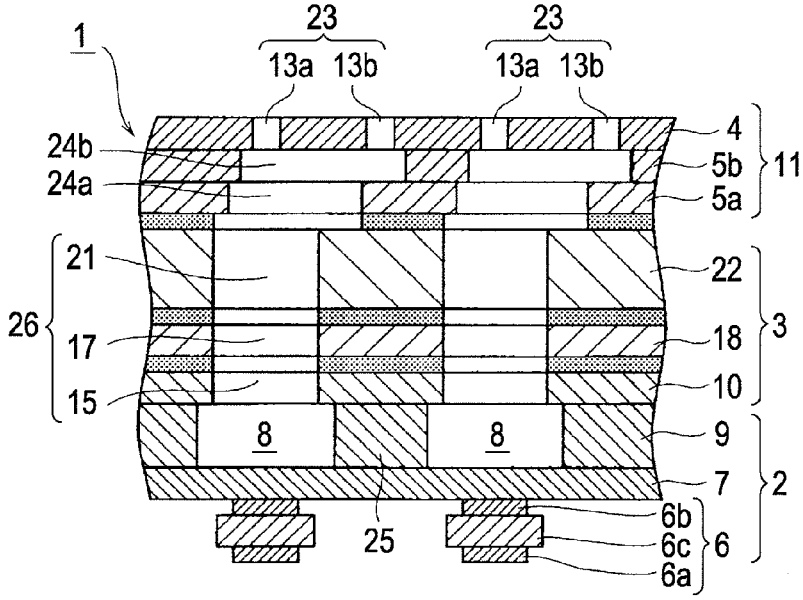
FIG. 2 is a cross-sectional view taken along the line A-A in FIG. 1.
Figure 3:
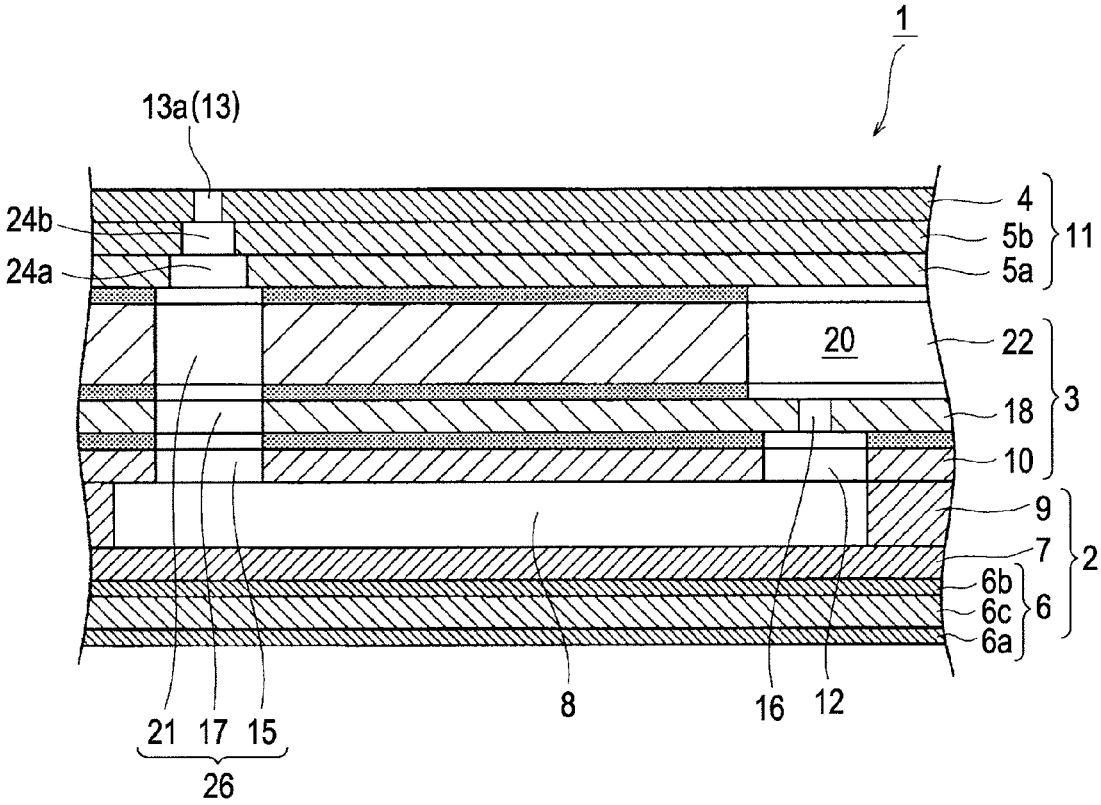
FIG. 3 is a cross-sectional view taken along the line B-B in FIG. 1.

FIG. 1 is an enlarged plan view illustrating a main portion when a recording head 1 is viewed from a nozzle plate. FIG. 2 is a cross-sectional view taken along the line A-A in FIG. 1. FIG. 3 is a cross-sectional view taken along the line B-B in FIG. 1.

The recording head 1 of the present embodiment is configured to include a pressure generating unit 2, a flow passage unit 3, and a nozzle unit 11 (nozzle plate 4 and nozzle communication plate 5), and all of which are integrally formed in a superposed state. The pressure generating unit 2 is configured to laminate a piezoelectric vibrator 6 (a kind of pressure generating means), a vibration plate 7, and a pressure generating chamber plate 9 for partitioning a pressure generating chamber 8, and all of which are integrally formed through baking processing or the like.

In addition, the flow passage unit 3 is configured to laminate a communication hole plate 10 in which a supplying communication hole 12 for supplying the ink to the pressure generating chamber 8 and a third communication hole 15 for supplying the ink from the pressure generating chamber 8 to a nozzle opening 13 are formed, a supply hole plate 18 in which a supply hole 16 and a second communication hole 17 are formed, and a reservoir plate 22 in which a reservoir 20 and a first communication hole 21 are formed. In addition, a plurality of nozzle communication plates 5 (5*a* and 5*b*) in which communication through holes 24 (24*a* and 24*b*) are provided is disposed between the reservoir plate 22 and the nozzle plate 4.

The vibration plate 7 is made of an elastic plate material and seals one opening of the pressure generating chamber 8. On an outside surface of the vibration plate 7 which is an opposite surface to the pressure generating chamber 8, a plurality of piezoelectric vibrators 6 is disposed in a state corresponding to each pressure generating chamber 8. The exemplified piezoelectric vibrator 6 is a so-called bending vibration mode vibrator, and is configured to include a driving electrode 6*a* and a common electrode 6*b* with a piezoelectric body 6*c* interposed therebetween. Further, when a driving signal is applied to the driving electrode of the piezoelectric vibrator 6, an electric field according to a potential difference is generated between the driving electrode and the common electrode. Then, the electric field is given to the piezoelectric body, and thus the piezoelectric body is deformed according to strength of the given electric field.

The pressure generating chamber plate 9 is formed in a state where a space for partitioning the pressure generating chamber 8 is passed through in a thickness direction of the plate. The pressure generating chambers 8 are provided in a row shape at an interval corresponding to dot formation density at a constant pitch, for example, the pitch of 180 dpi, and formed as elongated holes in a horizontal direction perpendicular to a lined-up direction. Adjacent pressure generating chambers 8 are partitioned by a partition wall 25 formed of a part of the pressure generating chamber plate 9. In terms of the partition wall 25, a thickness is secured to a certain extent so that an interaction between the adjacent pressure generating chambers 8 caused by change in pressure can be suppressed.

The communication hole plate 10 is configured of a plate material in which the third communication hole 15 and the supplying communication hole 12 are provided, and seals the other opening of the pressure generating chamber 8. The third communication hole 15 (communication hole close to the nozzle opening side) communicates with one end of the pressure generating chamber 8 on the side of the nozzle opening 13, and is a through hole whose diameter is set to be larger than that of the nozzle opening 13. The third communication hole 15 is formed in series with the second communication hole 17 and the first communication hole 21 to serve as a nozzle communication passage 26, and through which the ink is supplied from the pressure generating chamber 8 to the nozzle opening 13. In addition, the supplying communication hole 12 is a through hole which communicates with the other end of the pressure generating chamber 8 opposite to the third communication hole 15. The supplying communication hole 12 communicates the reservoir 20 with the pressure generating chamber 8 together with the supply hole 16 of the supply hole plate 18, and through which the ink is supplied from the reservoir 20 to the pressure generating chamber 8.

In the supply hole plate 18, a plurality of supply holes 16 passing through the supply hole plate 18 in a plate thickness direction is provided in correspondence with the supplying communication holes 12 of the communication hole plate 10. In addition, the second communication hole 17 passing through the supply hole plate in the plate thickness direction is formed in correspondence with the third communication hole 15 of the communication hole plate 10 and the first communication hole 21 of the reservoir plate 22. An inner diameter of the supply hole 16 is narrowed to be smaller than that of the supplying communication hole 12, and which is designed to give fluid resistance (flow resistance) to the ink passing through the supply hole 16.

The reservoir plate 22 is a plate-shaped member made of a metallic material such as a stainless material. In the reservoir plate 22, a space for partitioning the reservoir 20 is formed in a state of passing through the reservoir plate in the plate thickness direction. The upper and lower openings of the space are sealed by the supply hole plate 18 and the first nozzle communication plate 5*a* so as to partition the reservoir 20. The reservoir 20 serves as a common liquid chamber for a plurality of pressure generating chambers 8, and which is provided at every kind (color) of the ink. In addition, in the reservoir plate 22, the first communication hole 21 passing through the reservoir plate in the plate thickness direction is formed in correspondence with the second communication hole 17.

The communication hole plate 10, the supply hole plate 18, and the reservoir plate 22 are integrally formed by bonding these plates by using an adhesive or the like, and thus the flow passage unit 3 of the present embodiment is configured.

The nozzle plate 4 is a plate-shaped member made of a silicon material. In the nozzle plate 4, a plurality of nozzle openings 13 is arranged to form a nozzle array (nozzle opening group). In the present embodiment, one nozzle array (nozzle group) is configured to include '360' nozzle openings 13 which are provided in a pitch, for example 360 dpi, smaller than the formation pitch of the pressure generating chamber 8. The nozzle plate 4 is bonded with the flow passage unit 3 via the nozzle communication plate 5 (first nozzle communication plate 5*a* and second nozzle communication plate 5*b*) to be described later.

Further, the nozzle plate 4 may be made of a metallic material, an organic plastic film, or the like in addition to the exemplified silicon material.

Here, a group of nozzle set 23 is configured by the plurality of nozzle openings 13, for example, two nozzle openings 13 (13*a* and 13*b*) in the present embodiment. The respective nozzle openings 13*a* and 13*b* constituting the same nozzle set 23 communicate with the same pressure generating chamber 8 via a communication through hole 24 (24*a* and 24*b*) of the nozzle communication plate 5 to be described later and the nozzle communication passage 26 described above. As shown in FIG. 1, in the present embodiment, among two nozzle openings 13*a* and 13*b* constituting the nozzle set 23, one nozzle opening 13*a* is disposed in a region (corresponding to within a region in the nozzle plate 4 facing the pressure generating chamber 8) of the pressure generating chamber 8 in a state where the pressure generating chamber plate 9 is viewed in a projected manner from the nozzle plate 4 (hereinafter, the case of describing as "plan view" means this state). Further, the other nozzle opening 13*b* is disposed at the outside of the pressure generating chamber 8, specifically, in a region (a position superposing with the partition wall 25 in the projected view) of the partition wall 25 for partitioning the adjacent pressure generating chambers 8.

In order to implement the arrangement layout of the above-mentioned nozzle opening 13, it is characterized in that the recording head 1 includes a nozzle communication plate 5 in which the communication through hole 24 for communicating the pressure generating chamber 8 with the nozzle opening 13 is provided between the nozzle plate 4 and the pressure generating chamber plate 9, and more specifically, between the nozzle plate 4 and the reservoir plate 22. The nozzle communication plate 5 in the present embodiment is a plate material made of a silicon material, and is configured to include a plurality of pieces, specifically, '2' pieces of the first nozzle communication plate 5*a* and the second nozzle communication plate 5*b* in total. These nozzle communication plates 5*a* and 5*b* are not limited to the silicon material, and a metallic material such as a stainless steel may be used.

In the first nozzle communication plate 5*a*, the first communication through hole 24*a* is provided, and in the second nozzle communication plate 5*b*, the second communication through hole 24*b* is provided. In the present embodiment, these communication through holes 24*a* and 24*b* are formed by using a dry etching process. In addition, in a case where the nozzle communication plate 5 is made of a metallic material, it may be provided by using a press work.

As shown in FIG. 1, the first communication through hole 24*a* in the present embodiment is a space for communicating the nozzle communication passage 26 with the second communication through hole 24*b*, and formed in an ellipsoid shape which elongates in the lined-up direction of the pressure generating chambers. In a state where the respective constituent parts of the recording head 1 are positioned and laminated, the first communication through hole 24*a* is disposed such that the center thereof is shifted close to the adjacent pressure generating chamber 8 (right side in FIG. 1) with respect to the center line CL in a width direction of the pressure generating chamber 8. One end portion (end portion at the left side in FIG. 1) in the longitudinal direction of the first communication through hole 24*a* is positioned in a region of the pressure generating chamber 8 in plan view. Further, the other end portion (end portion at the right side in FIG. 1) of the first communication through hole 24*a* is positioned at the outside of the pressure generating chamber 8 and in a region of the partition wall 25 between the adjacent pressure generating chambers 8 in plan view.

In addition, the second communication through hole 24*b* in the present embodiment is a space for communicating the first communication through hole 24*a* and the respective nozzle openings 13 of the nozzle set 23, and is formed in an ellipsoid shape which is longer in the lined-up direction of the pressure generating chambers and is shorter in a direction perpendicular to the lined-up direction of the pressure chambers compared with the first communication through hole 24*a*. In a state where the respective constituent parts of the recording head 1 are positioned and laminated, the second communication through hole 24*b* is disposed such that the center thereof is shifted closer to the adjacent pressure generating chamber 8 than the center of the first communication through hole 24*a* with respect to the center line CL in the width direction of the pressure generating chamber 8. That is, the center of the second communication through hole 24*b* of the second nozzle communication plate 5*b* positioned closest to the nozzle plate 4 side among the nozzle communication plates 5*a* and 5*b* becomes a shifted state with respect to the center of the first communication through hole 24*a* of the first nozzle communication plate 5*a* positioned closest to the pressure generation plate 9 side.

One end portion (end portion at the left side in FIG. 1) in the longitudinal direction of the second communication through hole 24*b* is positioned in a region of the first communication through hole 24*a* in plan view. Further, the other end portion (end portion at the right side in FIG. 1) of the second communication through hole 24*b* is positioned at the outside of the pressure generating chamber 8 and the first communication through hole 24*a*, and in a region of the partition wall 25 between the adjacent pressure generating chambers 8 in plan view, in other words, in a region superposing with the partition wall 25. The first communication through hole 24*a* is formed in a state where the respective nozzle openings 13*a* and 13*b* constituting the nozzle set 23 are included in plan view.

In the present embodiment, for example, the first nozzle communication plate 5*a*, the second nozzle communication plate 5*b*, and the nozzle plate 4 are integrated in a laminated state by anodic bonding, so that the nozzle unit 11 is configured. Then, the pressure generation unit 2 is bonded to be formed integrally with the flow passage unit 3, and the flow passage unit 3 is bonded to be formed integrally with the nozzle unit 11. As shown in FIG. 3, the reservoir 20 and the other end portion of the pressure generating chamber 8 communicate through the supply hole 16 and the supplying communication hole 12. In addition, the one end of the pressure generating chamber 8 and the nozzle opening 13 communicate through the nozzle communication passage 26 made of the first communication hole 21 to the third communication hole 15. Further, the nozzle communication passage 26 and the respective nozzle openings 13 of the nozzle set 23 communicate through the first communication through hole 24*a* and the second communication through hole 24*b*. A series of ink passage (fluid passage) which passes through from the reservoir 20 to the pressure generating chamber 8 and communicates with the nozzle opening 13 is formed in each of the nozzle sets 23.

In the recording head 1 with such a configuration described above, by driving the piezoelectric vibrator 6 to deform the vibration plate 7, a volume of the corresponding pressure generating chamber 8 shrinks and expends and pressure variation in the ink occurs in the pressure generating chamber 8. By this pressure variation, the ink is simultaneously ejected from each of the nozzle openings 13 constituting the nozzle set 23.

Figure 4:
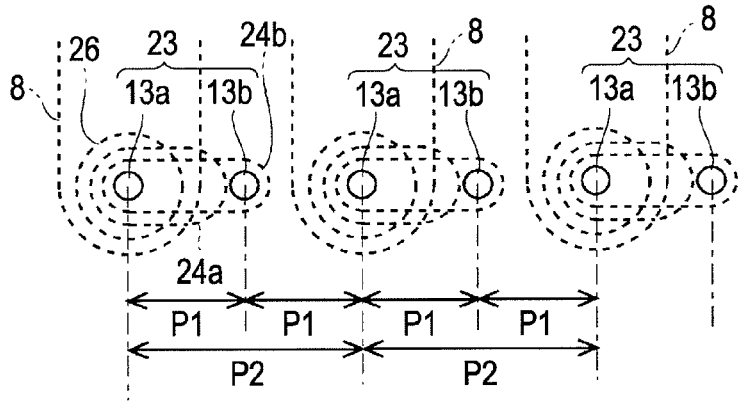
FIG. 4 is a view illustrating an arrangement layout of a nozzle opening.

As such, the nozzle communication plates 5*a* and 5*b* are provided between the nozzle plate 4 and the pressure generating chamber plate 9, and a plurality of nozzle openings 13 communicates with respect to one pressure generating chamber 8 through the communication through holes 24*a* and 24*b* which are provided in the nozzle communication plates 5*a* and 5*b*. With such a configuration, flexibility in an arrangement layout of the nozzle opening 13 can be improved without being easily influenced by the formation pitch of the pressure generating chamber 8. As shown in FIG. 4, the arrangement layout may be adopted, in which at least one nozzle opening 13 among the nozzle openings 13*a* and 13*b* constituting the same nozzle set 23, that is, the plurality of the nozzle openings 13 communicating with the same pressure generating chamber 8 via the communication through holes 24*a* and 24*b* is disposed in the region of the partition wall 25 deviated from the region of the pressure generating chamber 8 in plan view. In particular, as in the present embodiment, the centers of the communication through holes 24*a* and 24*b* of the respective nozzle communication plates 5*a* and 5*b* are disposed by being shifted from each other, so that it is possible to deal with various layouts of the nozzle openings 13.

In the layout of the nozzle opening 13 shown in FIG. 4, the formation pitch P1 of the nozzle opening 13 in the lined-up direction of the pressure generating chambers becomes ½ of the formation pitch P2 of the pressure generating chamber 8. Therefore, the dot formation density (recording resolution) in the lined-up direction of the pressure generating chambers can be increased to twice that of the known configuration without using the invention. In addition, since the nozzle opening 13 can be disposed in the region of the partition wall 25 between the adjacent pressure generating chambers 8, it can contribute to downsizing of the recording head in comparison with the known configuration in which the pressure generating chambers are shifted in a staggered shape and thus the lined-up pitch of the nozzle openings in the lined-up direction of the pressure generating chambers is constant.

A printer mounting the above-mentioned recording head 1 is provided with the pressure generating chambers 8, and each of which is associated with the nozzle set 23 made of a set of plural nozzle openings 13. Therefore, the ink can be simultaneously ejected from each of the nozzle openings 13 of the nozzle set 23 corresponding to the pressure generating chamber 8 of a driving target by one ejecting operation. Further, it is possible to efficiently fill a predetermined region on the recording medium such as a recording paper with an amount of ink smaller than that in the known apparatus by the ink ejected from each of the nozzle openings 13. Accordingly, the ink consumption, that is, the total amount of ink landed on the recording medium upon recording images can be suppressed, and as a result, it is possible to suppress distortion of the recording paper or feathering of the recording image caused by moisture contained in the ink. In addition, since the ink consumption can be suppressed, it is possible to contribute to the low running cost or environment conservation.

Figure 5:
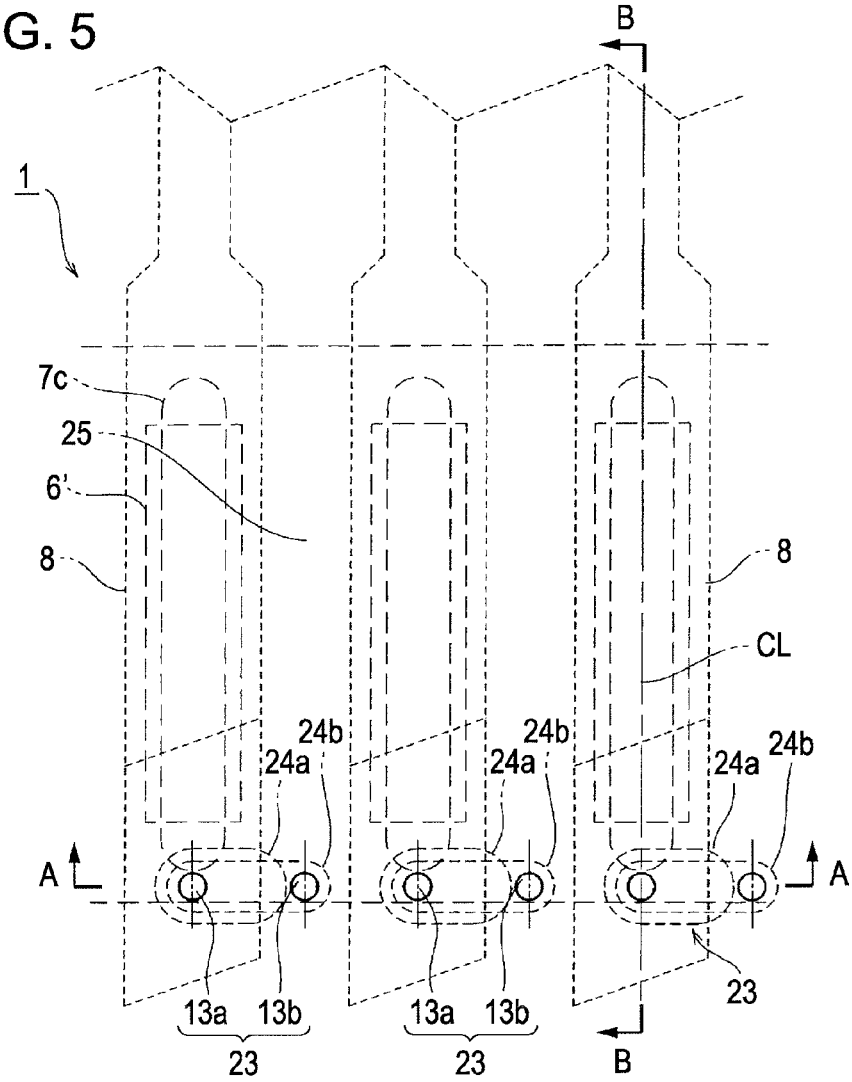
FIG. 5 is an enlarged plan view illustrating a main portion of a recording head according to a second embodiment.
Figure 6:
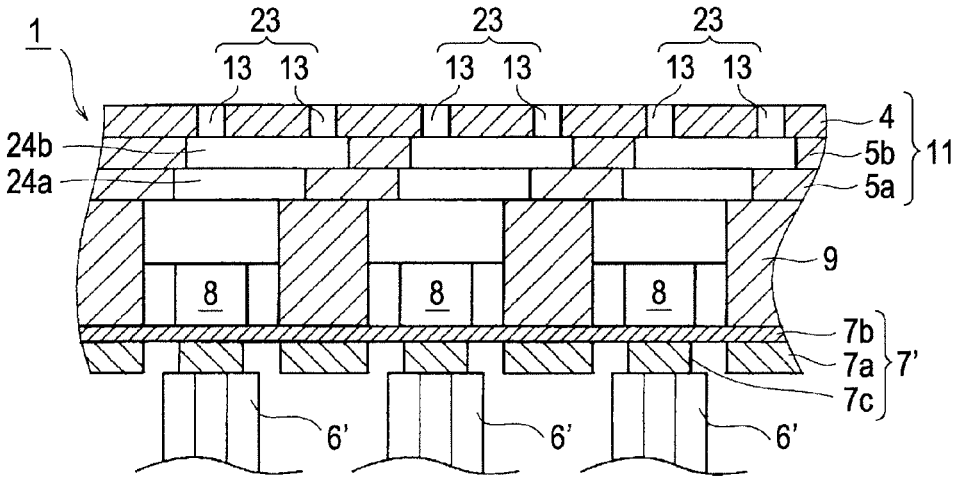
FIG. 6 is a cross-sectional view taken along the line A-A in FIG. 5.
Figure 7:
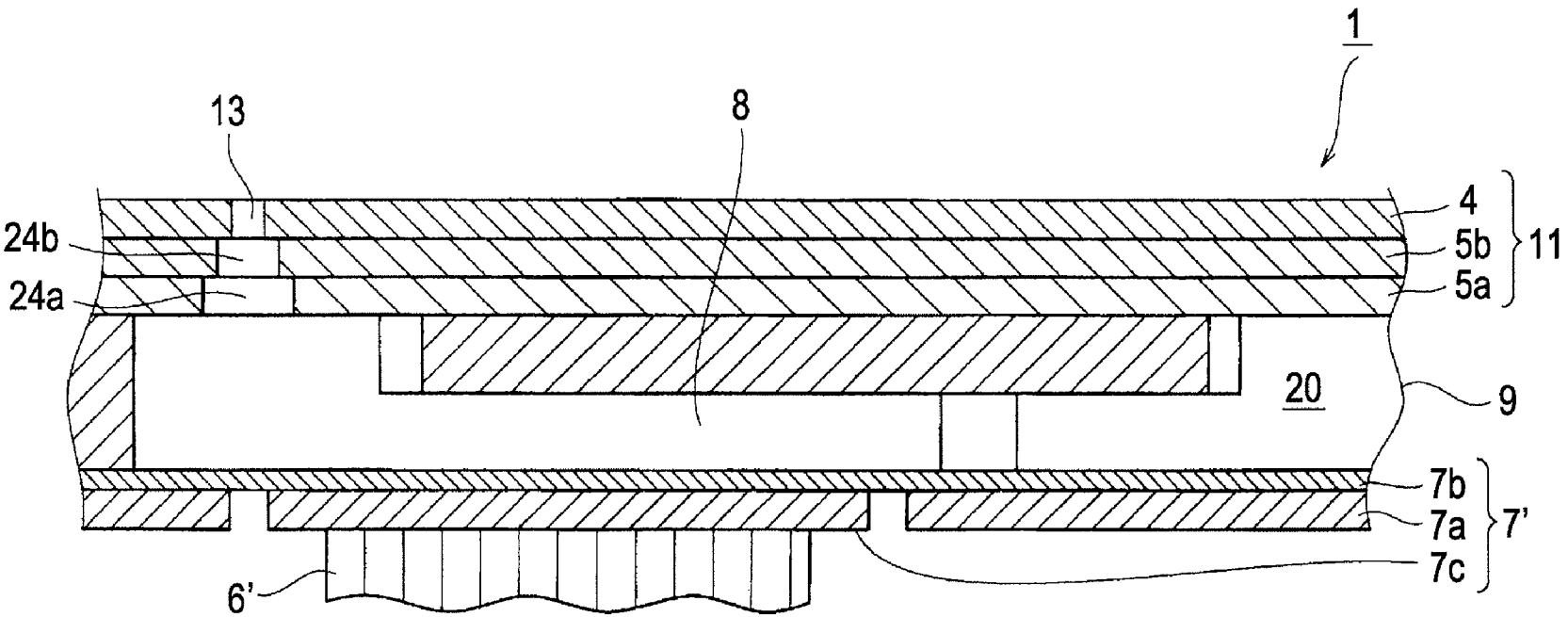
FIG. 7 is a cross-sectional view taken along the line B-B in FIG. 5.

In addition, in the above-mentioned embodiment, the so-called bending vibration mode piezoelectric vibrator 6 has been shown as an example of the pressure generation means, but the invention is not limited thereto. For example, as the second embodiment shown in FIGS. 5 to 7, the so-called longitudinal vibration mode piezoelectric vibrator 6' may be adopted which is shifted in a direction perpendicular to an electric field direction. In the second embodiment, a vibration plate 7' is made of a composite plate material in which an elastic film 7*b* is laminated on a metallic support plate 7*a*. Then, an island portion 7*c* is formed on a portion corresponding to the pressure generating chamber 8 independently of the support plate 7*a* through etching processing, and the tip surface of the piezoelectric vibrator 6' is bonded to the island portion 7*c*. In the second embodiment, the nozzle communication plates 5*a* and 5*b* are provided between the nozzle plate 4 and the pressure generating chamber plate 9, and a plurality of nozzle openings 13 constituting the nozzle set 23 communicates to one pressure generating chamber 8 through the communication through holes 24*a* and 24*b* which are provided in the nozzle communication plates 5*a* and 5*b*.

Figure 8:
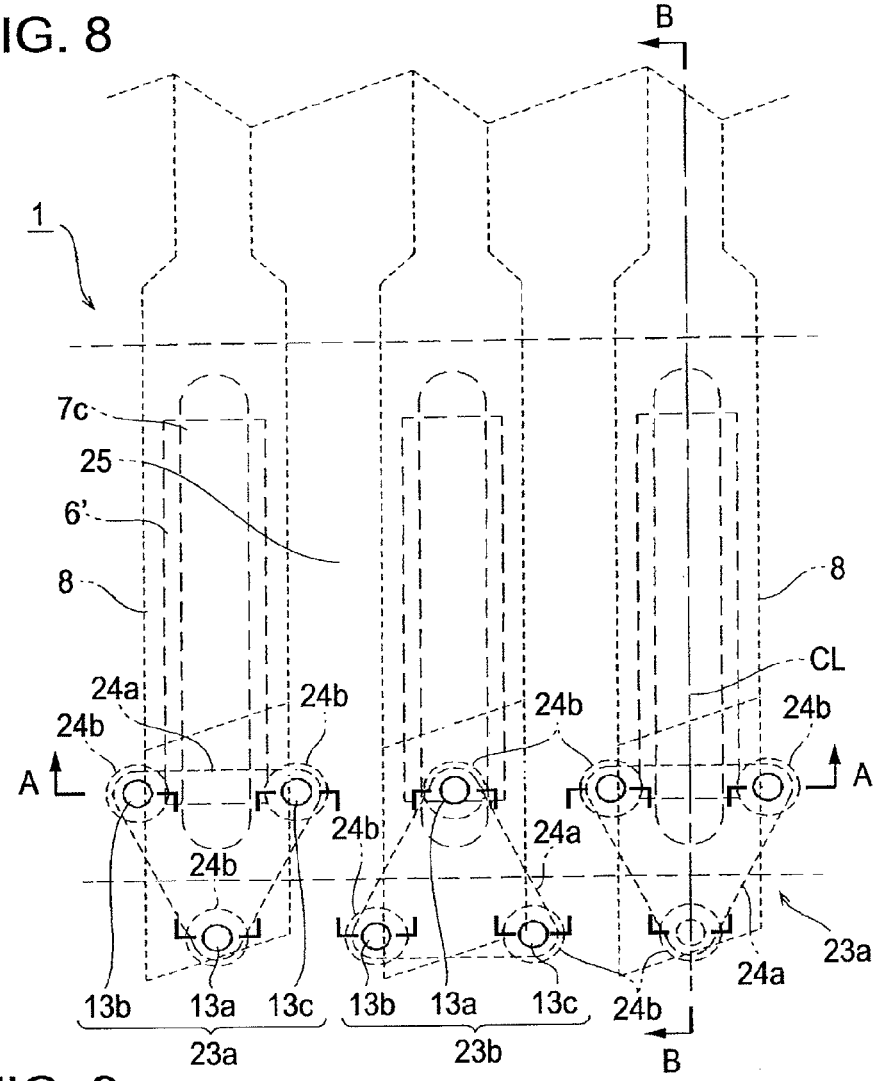
FIG. 8 is an enlarged plan view illustrating a main portion of a recording head according to a third embodiment.
Figure 9:
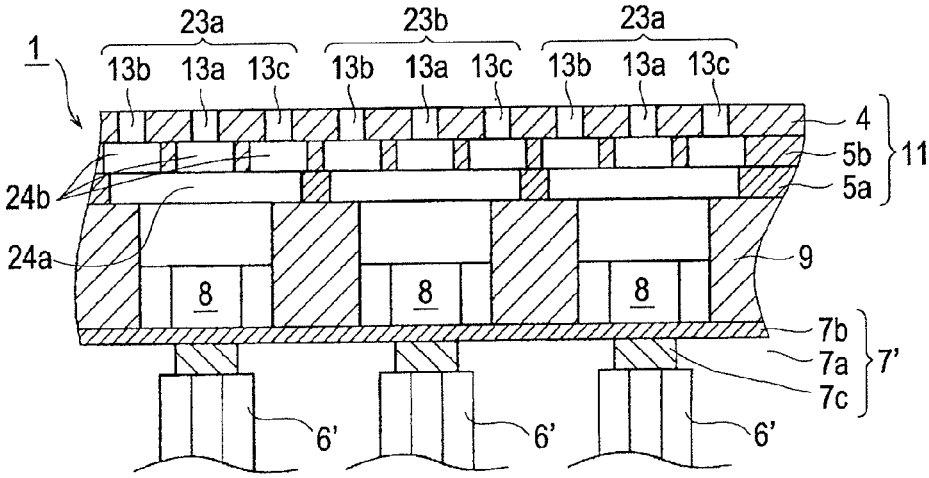
FIG. 9 is a cross-sectional view taken along the line A-A in FIG. 8.
Figure 10:
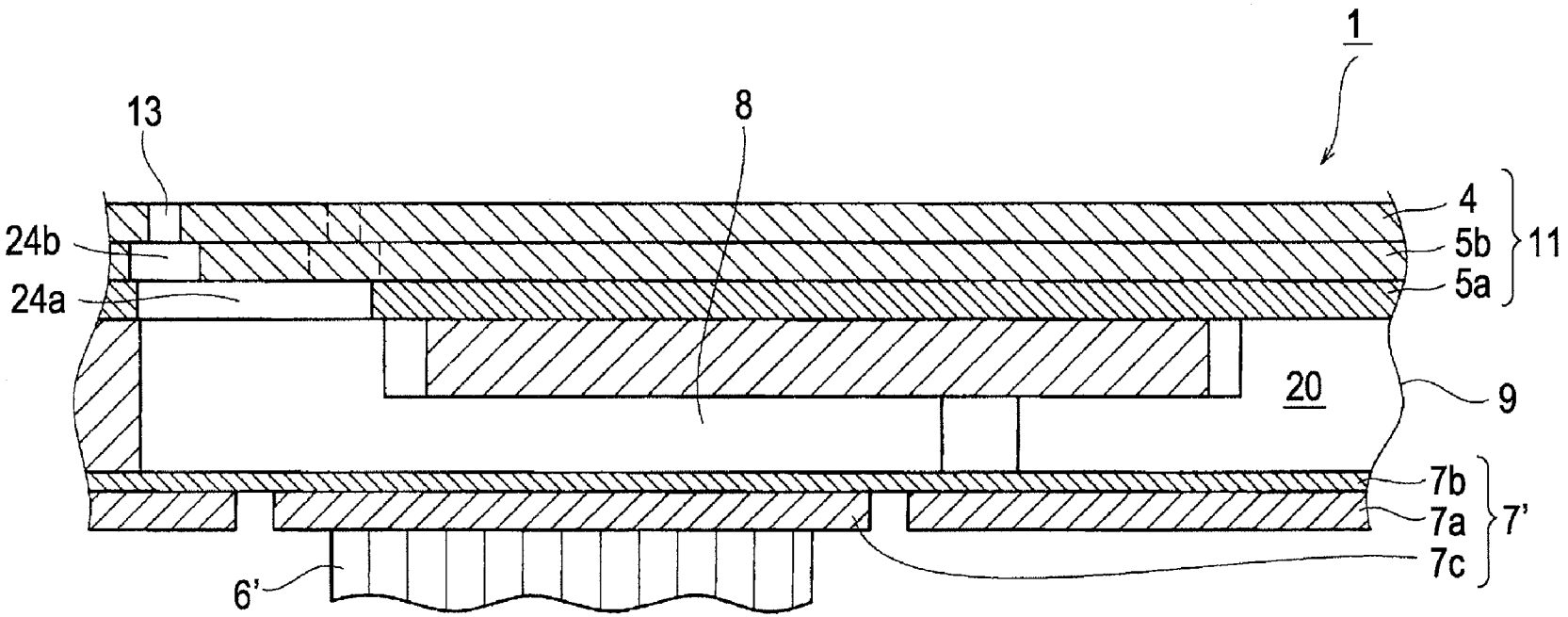
FIG. 10 is a cross-sectional view taken along the line B-B in FIG. 8.

Further, as a third embodiment shown in FIGS. 8 to 10, a layout may be adopted in which the nozzle set 23 is configured to include three nozzle openings 13*a*, 13*b*, and 13*c* in total, and the nozzle openings 13 are disposed in a polygonal shape (in this example, a triangular shape (isosceles triangular shape or equilateral triangular shape)). In addition, FIG. 9 is a cross-sectional view illustrating all nozzle openings 13 transversely taken along the line A-A in FIG. 8 in a zigzag manner. As shown in FIG. 8, in the third embodiment, the plurality of nozzle sets 23 are disposed in the lined-up direction of the pressure generating chambers 8 in a state where orientations of the triangular shapes are different in the alternative manner. That is, a first nozzle set 23*a* in which the first nozzle opening 13*a* corresponding to a vertex angle of the triangle among the nozzle openings 13 in the same nozzle set 23 is disposed at the outside of the center portion in the longitudinal direction of the pressure generating chamber 8, and a second nozzle set 23*b* in which the first nozzle opening 13*a* is disposed at the inside of the center portion of the pressure generating chamber are disposed in the lined-up direction of the pressure generating chambers 8 to each other. In such a configuration, the second nozzle opening 13*b* and the third nozzle opening 13*c* are disposed at the outside of the region of the pressure generating chamber 8 (in the region of partition wall 25).

The first communication through hole 24*a* in the present embodiment is a substantially triangle-shaped through hole which commonly communicates with the respective nozzle openings 13 of the nozzle set 23, and a length of its one side is set to be slightly larger than the dimension of the pressure generating chamber 8 in the width direction. On the other hand, the second communication through hole 24*b* is a circular through hole which separately communicates with the nozzle openings 13 of the nozzle set 23, and its inner diameter is set to be slightly larger than the inner diameter of the nozzle opening 13. The second communication through hole 24*b* is formed such that at least a part thereof is superposed with the first communication through hole 24*a* in plan view and includes the nozzle opening 13 corresponding to the nozzle set 13.

According to the configuration of the present embodiment, without interfering the nozzle opening 13 and the communication through hole 24 with each other between the adjacent pressure generating chambers 8, the formation density of the nozzle openings 13 in the lined-up direction of the pressure generating chambers can be increased at the minimum space. That is, in the exemplified layout of the nozzle opening 13, the formation pitch of the nozzle opening 13 as viewed in the lined-up direction of the pressure generating chambers is reduced to ⅓ of the lined-up pitch of the pressure generating chamber 8. Therefore, the dot formation density (recording resolution) in the lined-up direction of the pressure generating chambers can be increased to 3 times that of the known configuration without using the invention. In addition, the dot formation density can be further increased by forming in a polygonal shape other than the triangular.

Further, in the above-mentioned embodiments, the nozzle communication plate 5 is configured to include '2' pieces of the first nozzle communication plate 5*a* and the second nozzle communication plate 5*b* in total, but the invention is not limited thereto, and can adopt a configuration in which one or three or more pieces of nozzle communication plates 5 are provided. In short, it is sufficient that if the plurality of nozzle openings is configured to communicate with one pressure generating chamber through one or more communication through holes without interfering the flow passage of the adjacent pressure generating chambers (including the pressure generating chamber 8, the nozzle communication passage 26, the communication through hole 24, and the nozzle opening 13).

As such, it is possible to efficiently increase the number of nozzles while using the same members as that of the known pressure generating chamber which configures the pressure generating chamber from the pressure generation means.

Further, in the above description, the recording head 1 which is mounted on a printer (a kind of liquid jet apparatus) is exemplified as the liquid jet head according to the invention. However, the invention is applicable to other liquid jet heads. For example, the invention is applicable to a color material jet head used for manufacturing a color filter such as a liquid crystal display etc., an electrode material jet head used for an electrode formation such as in an organic EL (Electro Luminescence) display, FED (surface-emitting display) etc., a bio organic jet head used for manufacturing a bio chip (bio chemical element), and the like.

Figure 11:
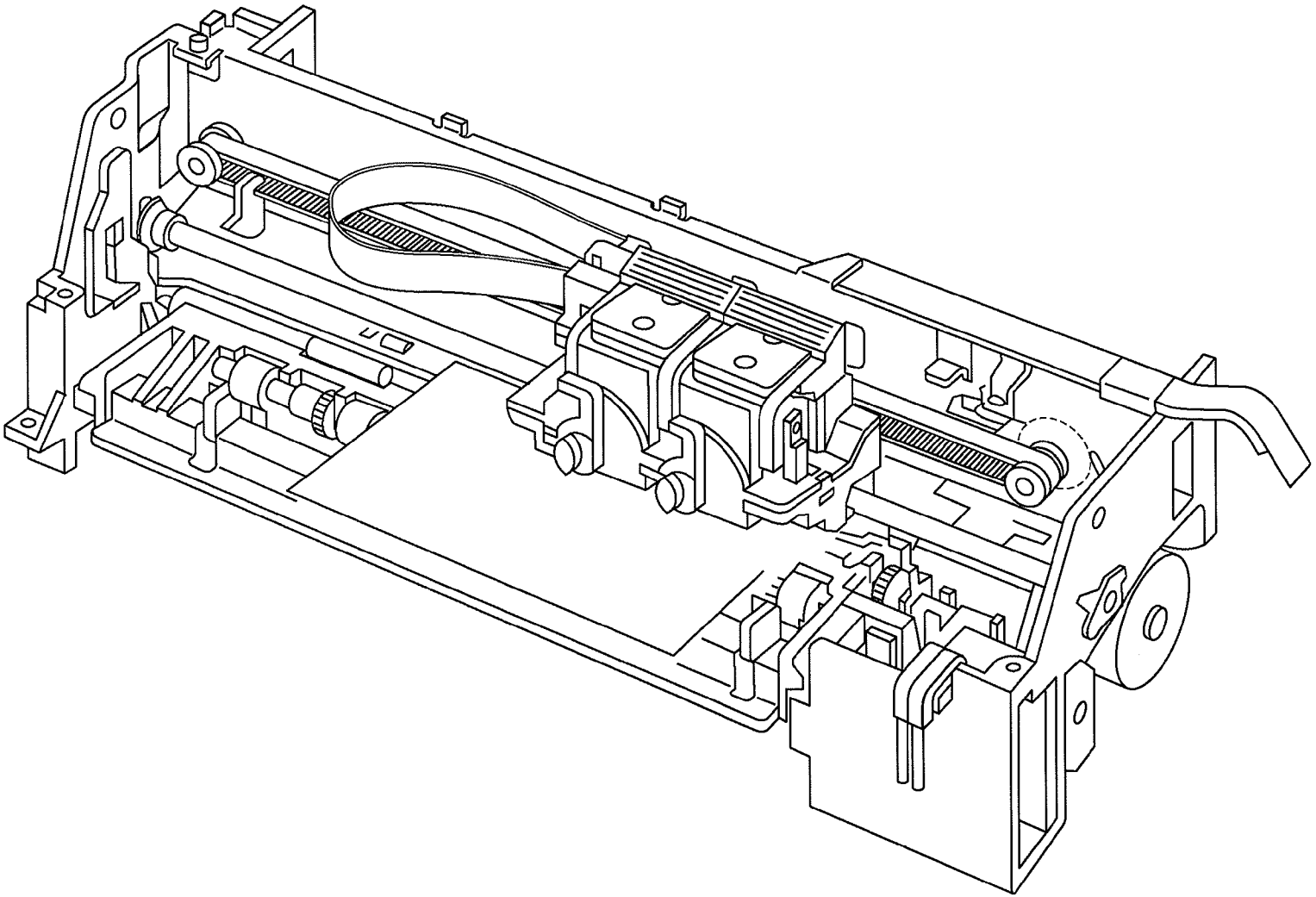
FIG. 11 is an overall view illustrating a liquid jet apparatus on which a liquid jet head is mounted.

FIG. 11 shows a liquid jet apparatus which mounts the liquid jet head. With the liquid jet apparatus, the flexibility in an arrangement layout of the nozzle opening can be improved, and a high density arrangement of nozzles is possible, so that ejecting results with high density can be obtained.

The invention claimed is:

1. A liquid jet head comprising:

a pressure generation element;

a nozzle plate which is provided with a nozzle opening;

a pressure generating chamber plate in which a pressure generating chamber for communicating with the nozzle opening is formed; and a plurality of nozzle communication plates, provided between the nozzle plate and the pressure generating chamber plate, wherein each nozzle communication plate comprises a communication through hole for communicating one pressure generating chamber with a plurality of nozzle openings, wherein the communication through holes communicate with each other in a state in which the center of the communication through hole of the nozzle communication plate closest to the nozzle plate among the plurality of nozzle communication plates is shifted with respect to the center of the communication through hole of the nozzle communication plate closest to the pressure generating chamber plate.

2. The liquid jet head according to claim 1, wherein at least a part of a plurality of the nozzle openings which communicate with the same pressure generating chamber via the communication through holes is disposed at the outside of a region facing the pressure generating chamber of the nozzle plate.

3. A liquid jet apparatus comprising the liquid jet head according to claim 1.

4. A liquid jet head comprising:

a pressure generation element;

a nozzle plate which is provided with a nozzle opening;

a pressure generating chamber plate in which a pressure generating chamber for communicating with the nozzle opening is formed; and a nozzle communication plate in which a communication through hole for communicating one pressure generating chamber with a plurality of nozzle openings is provided between the nozzle plate and the pressure generating chamber plate;

wherein the nozzle openings communicating with the same pressure generating chamber are disposed in a polygonal shape to configure a nozzle set, and wherein a plurality of the nozzle sets is disposed in a lined-up direction of the pressure generating chambers in a state where orientations of the polygonal shapes are different in an alternative manner.

5. The liquid jet head according to claim 4, wherein at least a part of a plurality of the nozzle openings which communicate with the same pressure generating chamber via the communication through hole is disposed at the outside of a region facing the pressure generating chamber of the nozzle plate.

6. A liquid jet apparatus comprising the liquid jet head according to claim 4.

* * * * *